US006527599B2

(12) United States Patent
Bechtold et al.

(10) Patent No.: US 6,527,599 B2
(45) **Date of Patent: *Mar. 4, 2003**

(54) HOUSING WITH INTEGRALLY MOLDED CONNECTORS

(75) Inventors: Kenneth V. Bechtold, Freeport, IL (US); S. Todd Sanders, Freeport, IL (US)

(73) Assignee: Honeywell Inc., Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/321,087

(22) Filed: May 28, 1999

(65) Prior Publication Data

US 2002/0142672 A1 Oct. 3, 2002

(51) Int. Cl.[7] ..... H01R 13/405

(52) U.S. Cl. ..... 439/736; 439/209; 439/535; 439/320; 439/638; 439/736

(58) Field of Search ..... 439/736, 540.1, 439/540, 535, 34, 731, 701, 209, 211, 638, 320, 650, 653, 654

(56) References Cited

U.S. PATENT DOCUMENTS

| | | | | |
|---|---|---|---|---|
| 3,157,449 A | * | 11/1964 | Hennessey | 439/736 |
| 4,272,689 A | * | 6/1981 | Crosby et al. | 307/147 |
| D425,483 S | | 5/2000 | Bechtold et al. | |
| 6,123,585 A | | 9/2000 | Hussong et al. | |
| 6,246,559 B1 | | 6/2001 | Sanders et al. | |

OTHER PUBLICATIONS

Brad Harrison, *Now You Can Generate More Ideas With More Products From One Source*, Control Engineering (Issue and Date Unknown).

Author Unknown, AS–i Interface, *World's Easiest Actuator/Sensor Network*, Control Engineering (Issue and Date Unknown).

Author Unknown, *Analog I/O Modules for Interbus*, Control Engineering (Issue and Date Unknown).

Efector, Inc., *We're Big on Position Sensing*, Control Engineering (Feb. 1999).

Omron, *Being the First Single–Loop Controller with DeviceNet Sets the E5EK–DRT Apart*, Control Engineering (Issue and Date Unknown).

Turck, *Nobody Delivers the Exact Connectors You Need, Faster*, Design News (Issue and Date Unknown).

Interlinkbt, *The Hottest Device–Level Bus Products, Served Up Fast, Just the Way You Want Them*, Unknown Source (Issue and Date Unknown).

Author Unknown, *High–Speed Industrial Network Cuts Operating Costs*, Design News (Issue and Date Unknown).

Advertisement, "Product Design" magazine, Apr. 2000, p. 31, Phoenix Contact.

* cited by examiner

*Primary Examiner*—Tho D. Ta
*Assistant Examiner*—Truc Nguyen
(74) *Attorney, Agent, or Firm*—Andrew A. Abeyta; Kris T. Fredrick; Allan W. Watts

(57) ABSTRACT

A connector block for connecting a plurality of electrical connectors includes a molded housing having a face. A plurality of female connectors are integrally molded within the face of the housing, each female connector having a well molded into the face of the housing and a receptacle extending from a bottom of the well. A threaded cylindrical bushing is integrally formed within the well around each receptacle. At least one male connector is also integrally molded within the housing.

25 Claims, 2 Drawing Sheets

HOUSING WITH INTEGRALLY MOLDED CONNECTORS

BACKGROUND OF THE INVENTION

1. Field of the Invention

This invention relates to a connector block having a plurality of integrally molded female connectors and one or more integrally molded male connector.

2. Discussion of Related Art

Connector blocks are used in a variety of electronic applications, such as to house and support bus systems. Connector blocks typically require a plurality of female connectors and one or more male connectors. Conventional connector blocks are often constructed from a molded housing having female connector components, such as receptacles and/or threaded bushings, inserted into the housing after the housing is molded. These connector blocks require several assembly steps to: (1) mold the housing; (2) assemble the female connector components; and/or (3) insert the assembled female connector components into the housing. In addition, conventional connector blocks sometimes require additional steps to assemble and insert male connectors into the housing.

Multiple assembly steps add cost and complexity to the manufacturing process. Additionally, such manufacturing process results in a connector block having many connection interfaces that are each susceptible to contamination from water, dirt and other contaminants. Previous methods for assembly of connector blocks require knurled, barbed or textured female and/or male connectors that are press-fit or sonic welded into receiving apertures in the housing. Alternatively, a two-piece housing is fitted around the female and/or male connectors. This alternative may require potting the housing using epoxies or other costly and messy assembly methods and materials.

There is therefore an apparent need for a low cost connector block formed in a unitary molded assembly.

SUMMARY OF THE INVENTION

It is one object of this invention to provide a connector block comprising a minimum number of components.

It is another object of this invention to provide a unitary connector block having molded-in components to reduce assembly time and assembly cost.

It is yet another object of this invention to provide a connector block having a low profile created by female connectors that are flush with a face surface of the connector block.

It is still another object of this invention to provide a connector block having integrally molded connectors that are impervious to contamination.

A connector block for connecting a plurality of electrical connectors is formed with a molded housing used to support internal electronics and related connectors. The housing is molded to form a face and a plurality of sides that define a cavity.

A plurality of female connectors are integrally molded within the housing. Preferably, the female connectors are generally flush with respect to the face of the housing. The female connectors preferably extend between the face and the cavity of the housing. The female connectors preferably each comprise a well molded into the face of the housing and a receptacle extending from a bottom of the well. The receptacle may include one or more channels extending from a top of the receptacle to the cavity. A connector pin may additionally be press-fit or insert molded within the channel.

Female connectors also include an integrally formed threaded bushing. The threaded bushing is positioned within each well of each female connector and is either insert molded or molded. from the same material as housing.

The connector block also preferably includes at least one male connector that is likewise integrally molded within the housing. Each male connector preferably includes a plurality of pins that are insert molded within the male connector and an externally threaded bushing integrally formed around the male connector.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
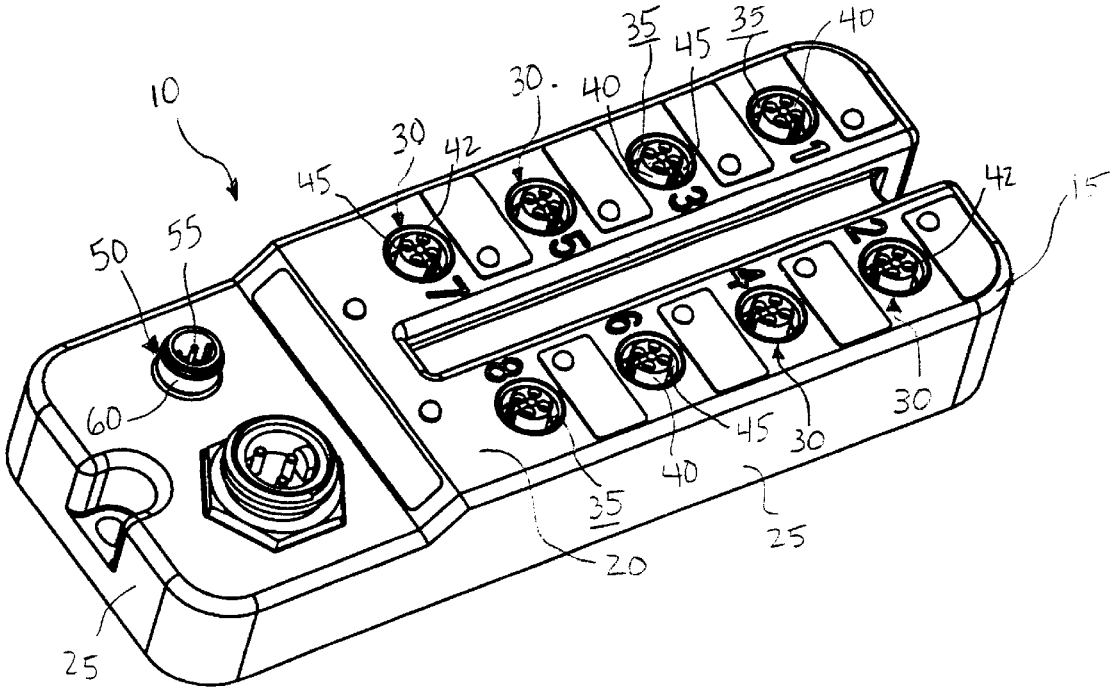
FIG. 1 is a perspective top view of a connector block according to one preferred embodiment of this invention.

Connector block 10 for connecting a plurality of electrical connectors is shown in FIG. 1. Connector block 10 is preferably formed with housing 15 used to support electronics and related connectors. According to one preferred embodiment of this invention, connector block 10 is used as a bus station for connecting multiple connectorized cables. Housing 15 is preferably molded from a thermoplastic material or other non-conductive, durable material known to those having ordinary skill in the art.

Figure 2:
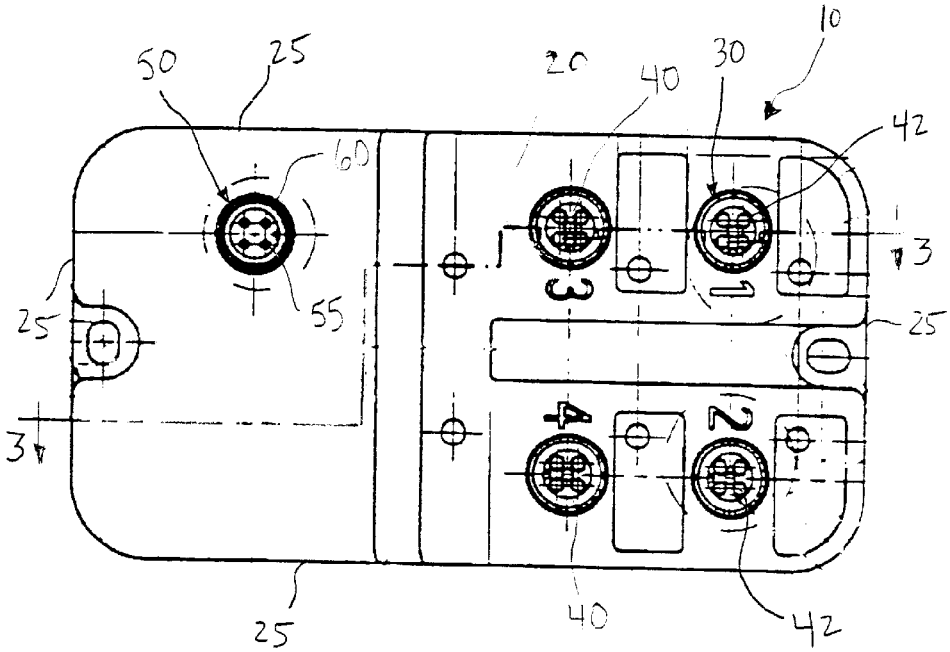
FIG. 2 is a top view of a connector block according to one preferred embodiment of this invention.
Figure 3:
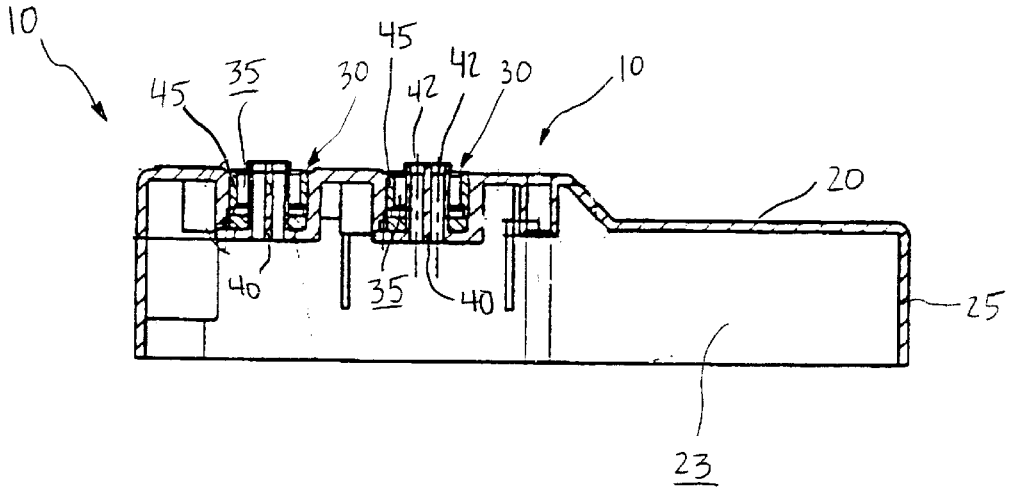
FIG. 3 is a cross-sectional side view of the connector block shown in FIG. 2.
Figure 4:
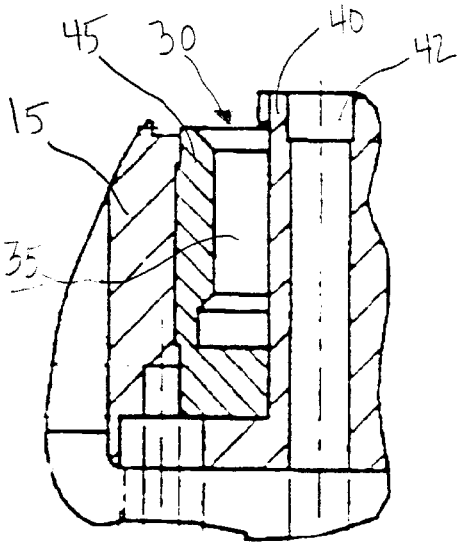
FIG. 4 is a detailed cross-sectional side view of a portion of the connector block shown in FIG. 3.

As shown in FIGS. 1–3, housing 15 is molded to form face 20 and a plurality of sides 25 surrounding face 20. Face 20 is preferably the external interface on connector block 10 into which connections are made and various indicator lights or other user interface devices may be connected. According to one preferred embodiment of this invention, four sides 25 extend from face 20 of housing 15. Cavity 23 necessarily results from the enclosure formed by the plurality of sides 25.

As shown in FIGS. 1–4, plurality of female connectors 30 are also integrally molded within housing 15. According to the required application, any number of female connectors 30 may be molded into housing 15, such as eight female connectors 30 shown in FIG. 1 or four female connectors 30 shown in FIG. 2. As shown in FIGS. 1 and 2, face 20 of housing 15 may be embossed with integrally formed numbers corresponding to each female connector 30 to facilitate proper connections. Female connectors 30 may accept three-pin connectors, four-pin connectors or any other configuration of connectors known to those having ordinary skill in the art.

Female connectors 30 preferably extend between face 20 and cavity 23 of housing 15. Such extension between face 20 and cavity 23 is required to facilitate communication between an external connection plugged into face 20 and internal electronics within connector block 10.

Female connectors 30 preferably comprise well 35 molded into face 20 of housing 15 and receptacle 40 extending from a bottom of well 35. According to one preferred embodiment of this invention, receptacle 40 is generally cylindrical in shape and includes channels 42 extending from a top of receptacle 40 to cavity 23. Such channels 42 thereby result in female connector 30 extending between face 20 and cavity 23. Such channels 42 typically correspond to the number of pins 55 in female connector 30. Therefore, a female connector 30 having three pins 55 would have three corresponding channels 42 formed within receptacle 40.

According to one preferred embodiment of this invention, each receptacle 40 further includes pin 55 engaged within channel 42. Pins 55 may be press-fit or alternatively, insert molded with respect to channel 42. Pins 55 are constructed from any suitable electrically conductive material known to those having ordinary skill in the art.

Female connector 30 additionally comprises threaded bushing 45 integrally molded with respect to each female connector 30. Threaded bushing 45 is preferably cylindrical and internally threaded to facilitate connection with a corresponding threaded male connector. Threaded bushing 45 is positioned within well 35 of each female connector 30. Threaded bushing 45 is either integrally formed within well 35 of housing 15 of the same material as housing 15 or, according to another preferred embodiment of this invention, is a metal component that is insert molded within each female connector 30.

According to one preferred embodiment of this invention, female connectors 30 are generally flush with respect to face 20 of housing 15. Housing 15 thereby assumes a lower overall profile by integrally forming female connectors 30 flush with respect to face 20. Flush female connectors 30 are also less susceptible to contamination or breakage than female connectors 30 that protrude from face 20 of housing 15.

As shown in FIGS. 1 and 2, connector block 10 preferably additionally comprises at least one male connector 50 integrally molded with respect to housing 15. Like female connectors 30, male connectors 50 are preferably molded into face 20 of housing 15 and are molded so that face 20 communicates with cavity 23 of housing 15.

Figure 5:
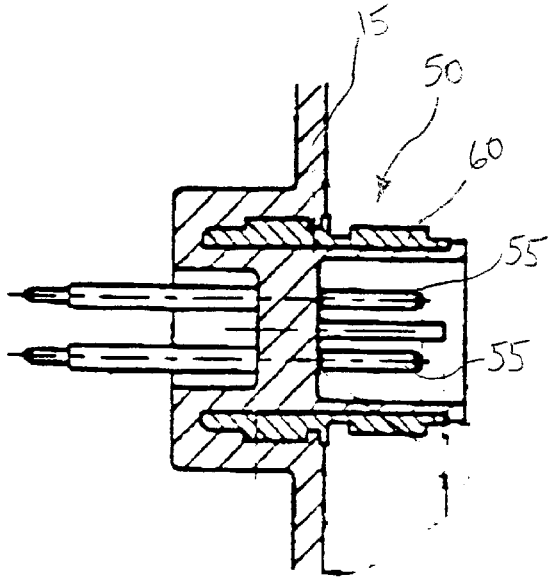
FIG. 5 is a cross-sectional view of a male connector of the connector block shown in FIG. 2.

As best shown in FIG. 5, male connector 50 preferably includes a plurality of pins 55 extending through male connector 50. According to one preferred embodiment of this invention, pins 55 are insert molded within male connector 50 and extend from a top of male connector 50 to cavity 23, thus forming an integrated component.

Male connector 50 preferably includes externally threaded bushing 60 formed around male connector 50. Externally threaded bushing 60 may be an insert molded bushing or integrally formed of the same material as housing 15. Externally threaded bushing 60 is engageable with a corresponding threaded bushing on a female connector.

The resulting connector block 10 is a unitary component requiring very few, if any, additional assembly steps. In addition, because each connector is integrally formed, water and other forms of contamination will not pass between insertion interfaces between the connectors and face 20 of housing 15. Required inventory is also necessarily low because the number of separate connector components required for production is reduced.

While in the foregoing specification this invention has been described in relation to certain preferred embodiments thereof, and many details have been set forth for purpose of illustration, it will be apparent to those skilled in the art that the connector block is susceptible to additional embodiments and that certain of the details described herein can be varied considerably without departing from the basic principles of this invention.

We claim:

1. A connector block for connecting a plurality of electrical connectors, the connector block comprising:

a housing molded to form a face, four sides and a cavity formed between the four sides; and a plurality of cylindrical female connectors integrally molded with the housing in one continuous piece of the same material and extending between the face of the housing and the cavity of the housing; wherein at least one of said female connectors is threaded.

2. The connector block of claim 1, wherein each of said female connectors is threaded.

3. The connector block of claim 1 further comprising a cylindrical threaded bushing insert molded within each female connector.

4. The connector block of claim 1 wherein the female connectors are generally flush with respect to the face of the housing.

5. The connector block of claim 1 wherein each female connector comprises a well molded into the face of the housing and a receptacle extending from a bottom of the well.

6. The connector block of claim 5 wherein the receptacle includes at least one channel extending from a top of the receptacle to the cavity.

7. The connector block of claim 6 wherein each receptacle further comprises a pin engaged within the at least one channel.

8. The connector block of claim 1 further comprising at least one male connector integrally molded with respect to the housing.

9. The connector block of claim 8 wherein the male connector further comprises a plurality of insert molded pins.

10. The connector block of claim 8, wherein the male connectors are threaded.

11. A connector block for connecting a plurality of electrical connectors, the connector block comprising:

a housing having a face;

a plurality of female connectors integrally molded within the face of the housing, wherein each female connector comprises a well molded into the face of the housing and a receptacle extending from a bottom of the well; and wherein the female connectors are threaded.

12. The connector block of claim 11 wherein the receptacle further comprises a plurality of channels communicating between the face of the housing and a bottom of the housing.

13. The connector block of claim 11 further comprising at least one male connector integrally molded with the housing.

14. The connector block of claim 13 wherein the male connector further comprises a plurality of insert molded pins.

15. The connector of claim 13, wherein the male connector is threaded.

16. A connector block for connecting a plurality of electrical connectors, the connector block comprising:

a housing molded to form a face, a plurality of sides; and a cavity a plurality of female connectors integrally molded within the face of the housing, wherein each female connector comprises a well molded into the face of the housing and a receptacle extending from the cavity into a position generally flush with the face of the housing;

wherein the female connectors are threaded; and wherein at least one of the female connectors is threaded.

17. The connector block of claim 16 wherein the male connector further comprises a plurality of insert molded pins.

18. A connector block comprising:

a housing having a face and one or more sides, said housing substantially comprising a non-conductive material;

at least four female connectors, integrally molded with the housing, each female connector comprising a well integrally molded with said housing and a receptacle extending from a bottom of the well, said receptacle integrally molded with said housing, each said receptacle having a plurality of channels, at least one said channel having at least one pin, each said pin substantially comprising an electrically conductive material, each said female connector having at least three pins; and at least one male connector integrally molded with said housing, said male connector having a plurality of pins, each one of said plurality of pins substantially comprising an electrically conductive material.

19. The connector block according to claim 18, said receptacles being substantially flush with said face.

20. The connector block according to claim 18 having four female connectors.

21. The connector block according to claim 19 having eight female connectors.

22. The connector block according to claim 18, said male connector being threaded.

23. The connector block according to claim 19:

said face being substantially perpendicular to the sides;

said connector block comprising at least eight female connectors;

at least one of said female connector being threaded; and said male connector being threaded.

24. The connector block according to claim 23:

said pins being insert molded in said housing;

said face being the top of said housing; and said face and said sides forming a cavity, said wells being in said cavity.

25. The connector block according to claim 24:

each said connector comprising a threaded bushing;

said housing having four sides;

said sides being joined by corners;

said corners being substantially rounded; and said bottom of said housing being substantially open.

* * * * *